US006357488B1

(12) United States Patent
Brossard et al.

(10) Patent No.: US 6,357,488 B1
(45) Date of Patent: Mar. 19, 2002

(54) PROCESS FOR THE TRANSFER OF ASEPTIC PRODUCTS BETWEEN TWO ENCLOSURES AND TRANSPORTATION CONTAINER FOR PERFORMING THIS PROCESS

(75) Inventors: Jean-Pierre Brossard, Chatou; Philippe Fontcuberta, Vendome, both of (FR)

(73) Assignee: La Calhene, Velizy Villacoublay (FR)

( * ) Notice: Subject to any disclaimer, the term of this patent is extended or adjusted under 35 U.S.C. 154(b) by 0 days.

(21) Appl. No.: 09/602,726

(22) Filed: Jun. 26, 2000

(30) Foreign Application Priority Data

Jul. 7, 1999 (FR) ..... 99 08781

(51) Int. Cl.[7] ..... B65D 3/00

(52) U.S. Cl. ..... 141/1; 141/97; 141/98; 141/231; 141/325; 141/327; 141/383

(58) Field of Search ..... 141/1, 97, 98, 141/231, 325–327, 383

(56) References Cited

U.S. PATENT DOCUMENTS 4,840,017 A 6/1989 Miller et al.
5,289,858 A * 3/1994 Grabenkort ..... 141/97
5,799,830 A * 9/1998 Carroll et al. ..... 222/95
5,858,016 A 1/1999 Bacehowski et al.

FOREIGN PATENT DOCUMENTS

EP 0 101 642 2/1984
EP 0 685 398 A1 12/1995

* cited by examiner

*Primary Examiner*—J. Casimer Jacyna
(74) *Attorney, Agent, or Firm*—Pearne & Gordon LLP

(57) ABSTRACT

In order to transfer aseptic products between two enclosures (34), use is made of a sterile container (10) having a filling interface (16) and an emptying interface (18). Each interface (16, 18) comprises a seal (24) behind which is placed a flexible hose (26) equipped with a closure system (30, 30'). The filling and emptying of the container (10) take place by connecting the corresponding interface (16, 18) and enclosure (34), sterilizing the volume trapped between the seal (24) and the door (42, 50) of the enclosure (34), opening said door and also the seal and putting into place the corresponding flexible hose (26). After filling the container (10), the closure system (30) of the filling interface (16) is closed again.

16 Claims, 3 Drawing Sheets

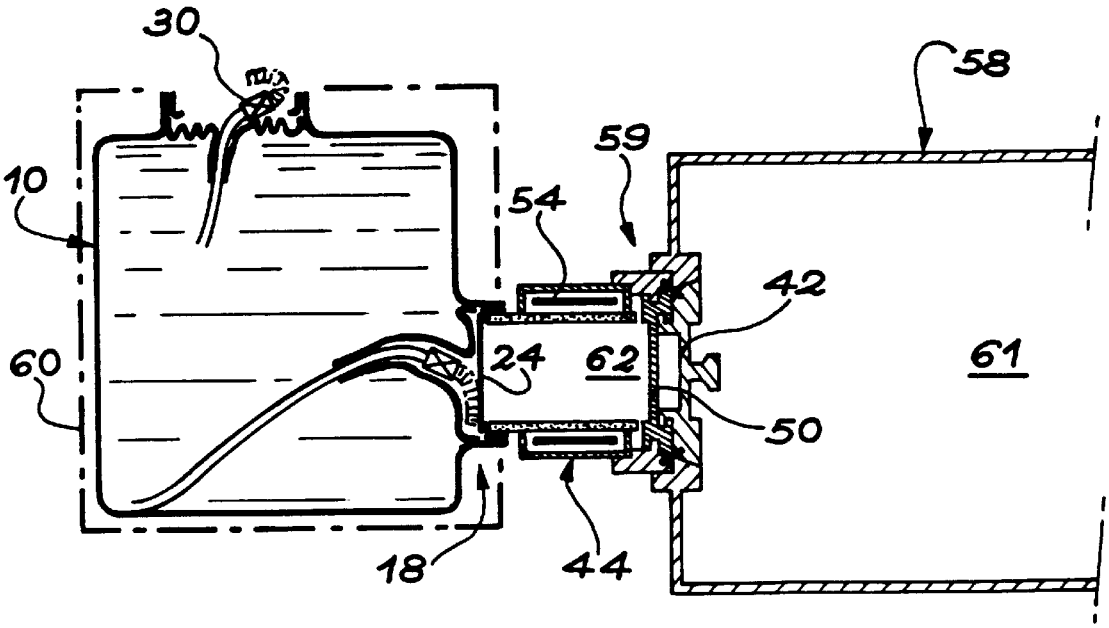
FIG. 2C
FIG. 2D
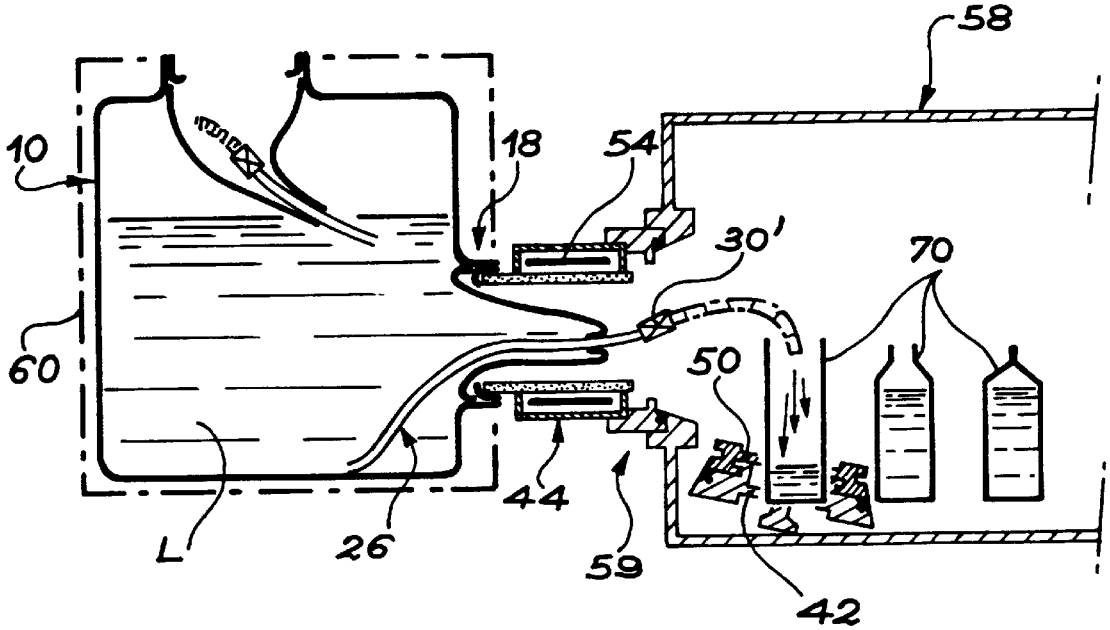

PROCESS FOR THE TRANSFER OF ASEPTIC PRODUCTS BETWEEN TWO ENCLOSURES AND TRANSPORTATION CONTAINER FOR PERFORMING THIS PROCESS

TECHNICAL FIELD

The invention relates to a process for the transfer of aseptic products between two enclosures such as a production enclosure and a use enclosure for said products.

The term "aseptic products" in the present context means any type of sterile product or product having a microbiological quality not to be deteriorated by an external contamination and no matter what the state thereof (liquid, gaseous, solid, powder, etc.) and no matter what the nature thereof (food, pharmaceutical and cosmetic products, packaging components, etc.).

The invention also relates to an aseptic product transportation container designed for performing such a transfer process.

PRIOR ART

In a certain number of industries, such as the food, pharmaceutical, cosmetic and similar industries, the product production and consumption locations are located at separate sites which are often far removed from one another.

Thus and solely as an example, the production and consumption locations of fruit juices are frequently on different continents. The procedure normally used for such products consists of pasteurizing them at their production locations, packaging them in large transportation containers, then bringing them to their consumption locations for repackaging in small size receptacles suitable for sale. Bearing in mind the precarious conditions under which product transfers take place both at the production location and at the consumption location, it is generally necessary to carry out a second pasteurization of these products before repackaging them. This leads to a loss of flavour and consequently quality for the product which is finally sold.

For carrying out the transportation of products between the production location and the consumption location, use is usually made of containers having a single interface used both for filling and emptying. However, certain containers have two separate accesses allocated respectively to filling and emptying.

Usually the transportation containers have flexible walls and they are placed in rigid cases during their filling and transportation. There are also some containers having semi-rigid walls with a adequate mechanical strength to ensure that they do not have to be placed in cases.

In the case of transportation containers equipped with a single interface used both for filling and emptying, certain solutions have been proposed in order to maintain the microbiological quality of the transported products, during transfers performed at the production and use locations of these products.

A first solution proposed by TETRA PAK (registered trademark) under the name "Tetra StarAsept" (registered trademark) consists of equipping a container in the form of a flexible bag with a rigid jacket defining an access opening. The rigid jacket is connected to one wall of the container and is normally sealed by a plug carried by the facing wall of said same container. In order to carry out filling, the plug is docked with an opening made in a production enclosure and initially sealed by a plug. The intermediate volume between the two plugs is sterilized by a vapour flow. The two plugs are then opened for filling the container. A new vapour sterilization of the upper part of the container then takes place prior to its closure.

Following the transportation of the container to the product use location, identical operations make it possible to empty the product into an adapted use enclosure.

In such a means, the seal between the container plug and the jacket is obtained by an O-ring. The decontamination of said O-ring during sterilization is of an arbitrary nature. This phenomenon is accentuated by a risk of soiling the O-ring by the transferred product (e.g. fruit juice pulp), which can even lead to a loss of sealing. In view of the fact that the product to be transferred passes twice through said zone in which decontamination is dubious, it is not possible to guarantee an absence of product deterioration between the product location and the use location.

The ASTEPO company proposes an aseptic filling installation using a principle similar to that proposed by TETRA PAK. This installation suffers the same disadvantages.

DESCRIPTION OF THE INVENTION

The present invention proposes a process for the transfer of aseptic products between two enclosures, whose original design makes it possible to avoid substantially any deterioration of the microbiological quality of the products, using a particularly simple, inexpensive and disposable transportation container.

According to the invention, this result is obtained by means of a process for the transfer of aseptic products between a first enclosure and a second enclosure, both equipped with a normally closed door, according to which a first transfer of products takes place from the first enclosure into a sterile container by a filling interface thereof and equipped with a seal, the container is transported to the second enclosure and a second transfer of products takes place from the container into the second enclosure by a container emptying interface equipped with a seal, characterized in that, prior to carrying out each of the first and second transfers:

a tight connection takes place of the corresponding interface and enclosure, a closed volume defined between the corresponding door and seal is sterilized, the corresponding door and seal are opened, to the corresponding enclosure is connected an initially closed flexible hose, which is within the container and connected tightly thereto about the corresponding seal and said flexible hose is opened, and characterized in that after carrying out the first transfer the flexible hose associated with the filling interface is closed again.

Here and throughout the text the term "flexible hose" is to be understood in its broadest sense as designating any pipe, duct, sleeve, tube, etc., which can be flexible or articulated and which can be folded within the container during its transportation and opened out into the enclosure to permit the passage of the products to be transferred, without them coming into contact with the tight connection zone of the container and the enclosure.

As a result of the presence of two access interfaces on the transportation container, its emptying takes place by a different interface from that used on its filling. Moreover, since each of the interfaces has a flexible hose by which the products are transferred, said products are never in contact with the walls decontaminated during the sterilization of the closed volume. As a result of these combined characteristics, any deterioration by an external contamination of the microbiological quality of the transferred products becomes virtually impossible. In the case of food products, there is consequently no longer a need for a repeated pasteurization at the use location, which leads to a significant improvement in the flavour of these products. Moreover, in the case of the transfer of aseptic components, a new contamination, which is generally difficult and costly, is avoided.

In a preferred embodiment of the invention, each of the enclosures is externally equipped with a lock having sterilization means and normally separated from the interior of the enclosure by the corresponding door and the corresponding container interface is connected to said lock in order to define the closed volume within the same.

In this case the closed volume is advantageously sterilized by using intermittent light sterilization means placed around a transparent tube defining said closed volume.

In order to improve the efficiency of the sterilization, use is then preferably made of seals, whose face turned towards the outside of the container is reflecting.

In the preferred embodiment of the invention, advantageously each lock is connected to the corresponding enclosure by means of a tight transfer device equipped with a double door materializing the corresponding door.

Preferably use is made of tearable seals, which undergo cutting from the inside of the corresponding enclosure after opening the door of said enclosure.

The invention also relates to a container for transporting aseptic products between a first enclosure and a second enclosure, said container comprising a filling interface and an emptying interface, both having an opening normally closed by a seal, characterized in that each of the filling and emptying interfaces also comprises an initially closed flexible hose, tightly connected to the corresponding opening within the container, the flexible hose of the filling interface being reclosable after opening.

Advantageously, the flexible hose of the filling interface is equipped with a means forming a valve permitting the reclosing thereof following opening.

In the preferred embodiment of the invention, the container comprises a flexible wall in which are integrated the filling interface and the emptying interface.

Each of the interfaces can then be defined either by an elastic part of the wall, or by a semi-rigid part of the wall.

BRIEF DESCRIPTION OF THE DRAWINGS

A preferred embodiment of the invention is described in non-limitative manner hereinafter with reference to the attached drawings, wherein show:

FIGS. 2A to 2D Diagrammatic sectional views illustrating different stages of the performance of the transfer process according to the invention using the container of FIG. 1.

DETAILED DESCRIPTION OF A PREFERRED EMBODIMENT OF THE INVENTION

Figure 1:
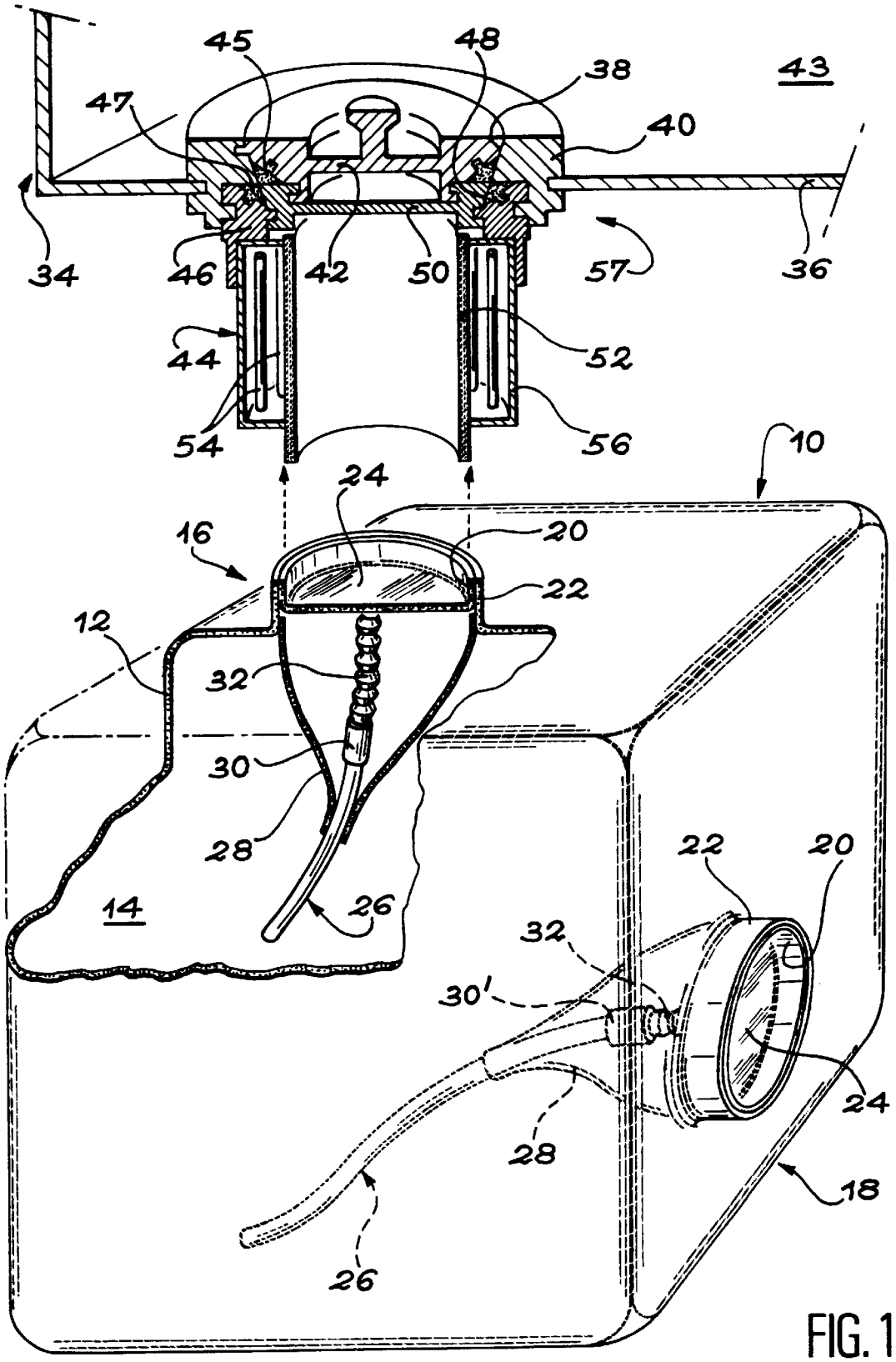
FIG. 1 A perspective view diagrammatically showing a transportation container according to the invention, with partial tearing away, as well as the adjoining part in section of a production enclosure to which can be connected the container filling interface.

In FIG. 1, reference numeral 10 designates in general terms a sterile transportation container according to the invention. The container 10 can have random shape and dimensions, which essentially depend on the envisaged application and in particular the nature of the aseptic products which it is wished to transfer. The cubic shape shown in FIG. 1 is only given in exemplified manner and must not be considered to limit the scope of the invention.

The container 10 comprises a tight wall 12 internally defining a closed volume 14. The nature and characteristics of the material constituting the wall 12 can be of a random nature. In the embodiment illustrated in FIG. 1, the wall 12 is a flexible wall. In this case, the container 10 must be placed within a not shown, rigid case during its filling and transportation.

According to the invention, the container 10 is equipped with two access orifices constituted by a filling interface 16 and an emptying interface 18. The filling interface 16 is preferably placed on the upper face of the wall 12 of the container 10. The emptying interface 16 can be placed in the bottom of a lateral face of the wall 12, as illustrated in FIG. 1, or on the upper face of said wall, alongside the filling interface 16. In the first case, the emptying of the container takes place by gravity, whereas the second case applies to a container which is emptied by pumping (case of a liquid or powder product).

Essentially the filling interface 16 and emptying interface 18 have identical characteristics. Thus, except when indicated otherwise, the following description applies to either of said interfaces.

Thus, each of the interfaces 16 and 18 comprises a generally circular opening 20 defined by an elastic or semi-rigid part 22 of the container wall 12. The opening 20 is normally closed by a seal 24 made from a material which can be torn or cut, as will be shown hereinafter. When the seals 24 are intact, they tightly close the openings 20.

In the embodiment using decontamination by intermittent light, each of the seals 24 is covered with a reflecting material on the face turned towards the outside of the container 10.

Within the container 10, each of the interfaces 16 and 18 also comprises a flexible hose 26. Said flexible hose 26 is tightly connected by a collar 28 to the part 22 of the flexible wall of the container defining the opening 20. In its part located between the collar 28 and the seal 24, the flexible hose 26 comprises sealing means 30, 30' closed when the container 10 has not yet been used, as well as a possibly extensible portion 32.

It should be noted that the sealing means 30 equipping the flexible hose 26 of the filling interface 16 must be closed again after opening. Consequently said sealing means are advantageously constituted by means forming a valve such as a valve integrated into the flexible hose or a clip which can be placed on a flexible portion of the flexible hose in order to ensure its closure by elastic deformation or welding.

However, the closure or sealing means 30' equipping the emptying interface 18 do not have to be closed again after opening. They can consequently be constructed in the same way as the sealing means 30 of the filling interface 16, or merely by an initially closed end of the flexible hose, which can be cut or perforated.

The assembly constituted here by the flexible hose 26 and the collar 28 can assume very different forms from those illustrated in FIG. 1 as a function of the type of products which it is wished to transfer. Thus, the small diameter flexible hose illustrated in FIG. 1, appropriate for the transfer of fluid products, will be replaced by a larger diameter flexible hose in the case where the products to be transferred are of a solid nature, such as packaging components. In this case, the collar 28 can be eliminated and the flexible hose 26 directly connected to the part 22 of the wall 12.

FIG. 1 also shows a part of a first enclosure 34, e.g. constituted by a production enclosure of the product to be transferred and to which the container 10 can be connected by its filling interface 16.

In said part of the enclosure 34, its tight wall 36 has a circular opening 38 defined by a flange 40. The opening 38 is normally tightly sealed by a door 42 in order to maintain the confinement of the closed volume 43 defined within the enclosure 34.

In the preferred embodiment of the invention illustrated in the drawings, a sterilization lock 44 is fitted to the access orifice formed in this way on the enclosure 34 and outside the same.

More specifically, the lock 44 comprises at one of its ends a flange 46 internally defining a circular opening 48, which is normally tightly closed by a door 50. The opposite end of the lock 44 is open and dimensioned in such a way that the part 22 of the filling interface 16 of the container 10 can be tightly connected thereto. This can be obtained either by an elastic deformation of the part 22, when it is elastic, or by a fitting of said part onto or into the corresponding end of the lock 44, when it is semi-rigid.

In the preferred embodiment of the invention illustrated in FIG. 1, the flanges 40 and 46 and the doors 40 and 52 form a double door, tight transfer device well known to the expert. In such a device, the connection of the flange 46 to the flange 40 and the connection of the door 50 to the door 42 take place simultaneously by bayonet systems. The doors 42 and 50 then form a double door, which can be opened from the interior of the enclosure 34. This connection device is also characterized by the use of sealing rings 45, 47 having a triangular cross-section and which effectively protect against contamination the surfaces of the openings 38 and 40.

The lock 44 is internally defined by a transparent tube 52, around which are regularly distributed lamps 54, materializing intermittent light sterilization means. These lamps 54 are surrounded by a protective casing 56.

The assembly described hereinbefore constitutes an interface 57 by which products prepared or stored in the enclosure 34 can be transferred to the interior of the container 10 by its filling interface 16 and with no risk of said products becoming contaminated.

As will be shown hereinafter, the transfer process according to the invention also uses a second enclosure 58 (FIGS. 2C and 2D) known as the "use enclosure". This second enclosure 58 is equipped with an interface 59 to which the emptying interface 18 of the container 10 can be connected in order to ensure the transfer of products into the use enclosure. The interface 59 equipping said latter enclosure 58 is preferably identical or similar to the interface 57 equipping the production enclosure 34. Consequently there will be no detailed description thereof and the comparable elements of the two interfaces 57 and 59 will subsequently be designated by the same reference numerals.

A description will now be given with reference to FIGS. 2A to 2D of the transfer process according to the invention using the container 10 of FIG. 1 and applied to the transfer of liquid products such as fruit juices.

When it is wished to ensure such a transfer between a first enclosure 34 (FIG. 2A) and a second enclosure 58 (FIG. 2C), which can be very remote from one another and e.g. located on different continents, one or more containers 10 are sterilized in their original state, i.e. with valves and seals closed and protected by a tight wrapping. This sterilization can take place by gamma irradiation using known procedures.

A sterilization lock 44 is connected to the production enclosure 34 (FIG. 2A) and an identical sterilization lock 44 is connected to the use enclosure 58 (FIG. 2C), as described hereinbefore with reference to FIG. 1. This is followed by the sterilization of the internal volume 43 of the production enclosure 34 and the internal volume 61 of the use enclosure 58 and the components within these two volumes. It is obvious that the operations relating to the production enclosure and the use enclosure are performed completely separately, especially when there is a very considerable distance separating these enclosures.

Figure 2B:
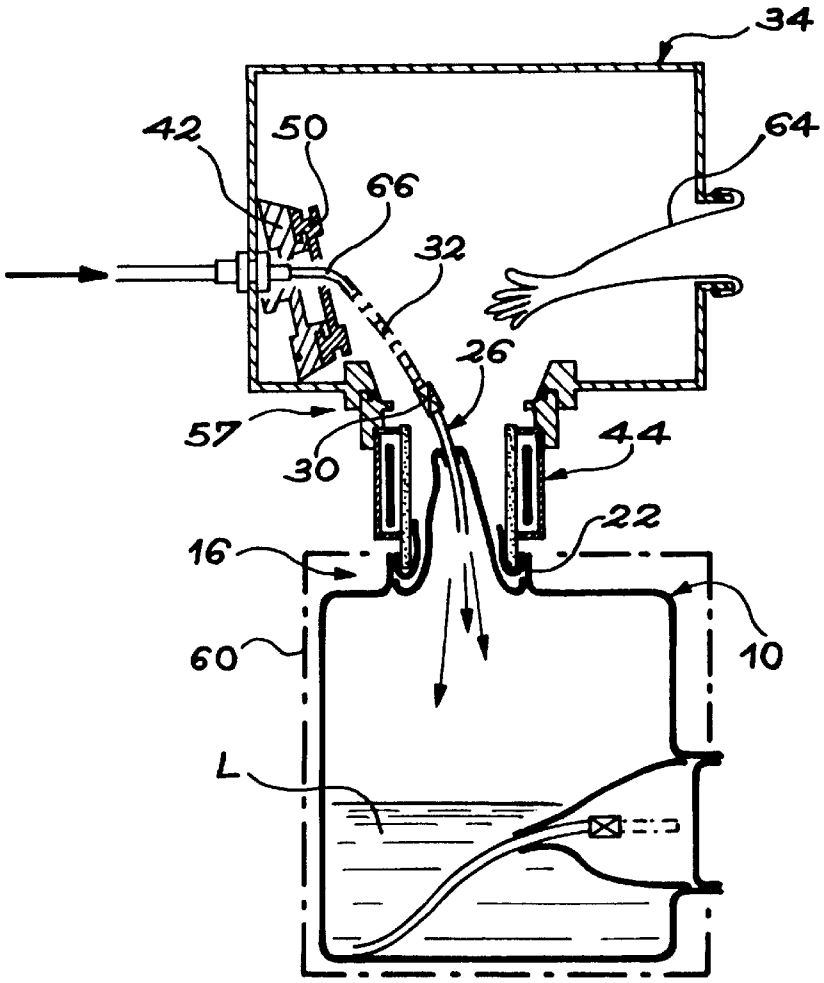
Figure 2A:
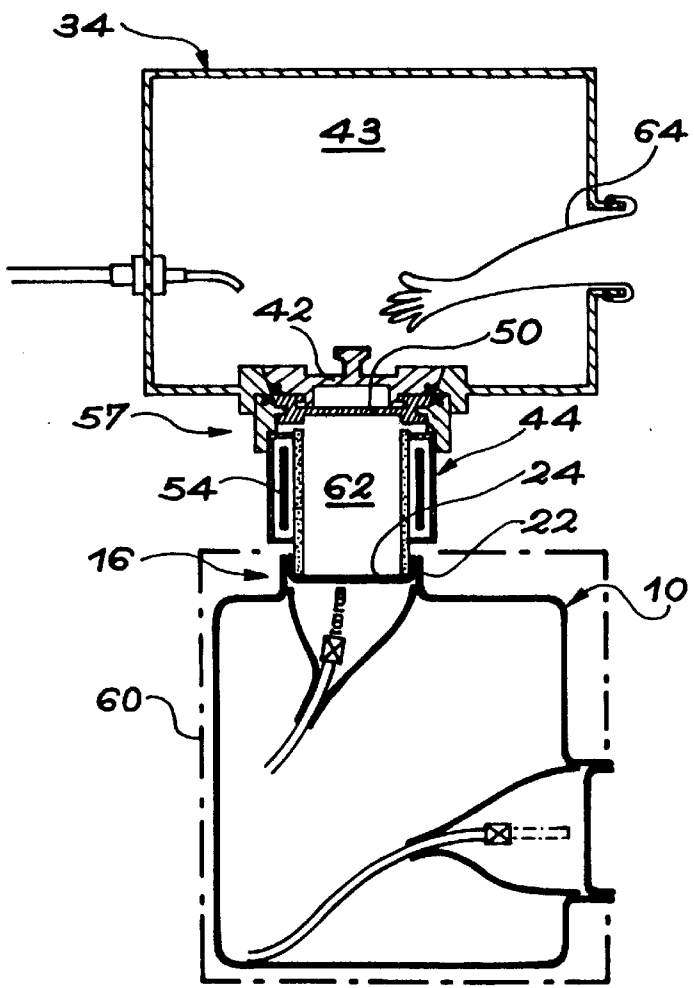

When it is wished to carry out a transfer of aseptic products between the enclosures 34 and 58, the protective wrapping of the container or containers 10 is opened and the filling interface 16 of one of these containers is tightly connected to the open end of the lock 44 equipping the first enclosure 34 (FIG. 2A). If necessary as a result of the mechanical strength of the wall 12 of the container 10, the latter is placed in a case 60.

The closed volume 62 then defined within the lock 44 between the seal 24 of the filling interface 16 and the double door 42, 50 separating the lock 44 from the closed volume 43 is then sterilized. To this end use is made of the sterilization means materialized by the lamps 54 equipping the lock 44. The external, reflecting surface of the seal 24 improves the sterilization quality of the closed volume 62.

When the closed volume 62 is sterilized, the double door materialized by the doors 42 and 50 is opened from the interior of the production enclosure 34. To this end use is made of handling means 64 equipping said enclosure. The operator then opens the seal 24 by tearing or cutting from the inside of the production enclosure 34.

As illustrated by FIG. 2B, this is followed by a connection of the end of the flexible hose 26 to a system such as a tube 66 placed within the first enclosure 34 and able to deliver the product to be transferred. This connection also takes place from the interior of the enclosure using the handling means 64 equipping it. In order to carry out this connection, the extensible part 32 of the flexible hose 26 is lengthened.

When the connection has taken place, the operator opens the closure means 30 equipping the flexible hose 26 so as to introduce the product to be transferred, such as a liquid L, into the container 10.

When said first transfer has taken place, the operator again closes the sealing means 30 and then disconnects the flexible hose 26 from the product delivery tube 66.

The double door materialized by the doors 42 and 50 is then put back into place and the part 22 of the interface 16 of the container 10 is disconnected from the open end of the lock 44. The transportation of the container 10 to the use location of the liquid L can then take place, e.g. in the case 60.

As is diagrammatically illustrated by FIGS. 2C and 2D, this is followed by the connection of the emptying interface 18 of the container 10 to the open end of the lock 44 equipping the second enclosure 58, followed by the transfer of the liquid L into said enclosure, by operations comparable to those described hereinbefore with reference to FIGS. 2A and 2B.

More specifically, the part 22 of the emptying interface 18 is tightly connected to the open end of the lock 44 equipping the second use enclosure 58. The closed volume 62 defined within the lock 44 between the seal 24 of the emptying interface 18 and the double door 42, 50 separating the lock from the second enclosure 58 is then sterilized. To this end use is made of lamps 54 forming the sterilization means equipping the lock 44.

From the interior of the enclosure 58, the operator then opens the double door materialized by the doors 42 and 50. By tearing or cutting from the inside of the enclosure 58, he then also opens the seal 24 of the emptying interface 18.

The following operation (FIG. 2D) consists of tightly connecting the end of the flexible hose 26 equipping the emptying interface 18 to a use system within the enclosure 58, such as a system able to deliver the liquid L to distribution receptacles 70 placed in the enclosure 58.

After opening the sealing means 30' equipping the flexible hose 26 of the emptying interface 18, when required, the container 10 is emptied into the receptacle 70.

When the emptying of the container 10 is ended, the flexible hose 26 is disconnected from the use system within the enclosure 58 and the double door materialized by the doors 42 and 50 is put back into place for closing the enclosure 58. The part 22 of the emptying interface 18 is then disconnected from the open end of the lock 44 and the container 10 is discarded.

The preceding description shows that the transfer process according to the invention, as well as the transportation container for performing this process, ensure the transfer of initially aseptic products between two enclosures without the microbiological quality thereof being deteriorated by an external contamination and this is independent of the distance separating the enclosures. In the case of food products such as fruit juices, this more particularly avoids a second pasteurization of these products at their use locations, which significantly improves their flavour when reaching the customer.

These advantages are more particularly obtained as a result of the fact that the emptying interface of the container is separate from its filling face and by the fact that the product is transferred, both during filling and emptying, without ever being in direct contact with walls contaminatable by the external atmosphere.

The invention is obviously not limited to the embodiment described in exemplified manner hereinbefore. In particular, the nature of the products transferred can be of a random nature and determines the shape and dimensions of the container. Moreover, although intermittent light sterilization is particularly advantageous, other sterilization means for closed volumes trapped between the container seals and enclosure doors can be used. Among these other processes reference is more particularly made to chemical decontamination or sterilization methods using a vapour flow, plasma, etc.

What is claimed is:

1. Process for the transfer of aseptic products between a first enclosure and a second enclosure, both equipped with a normally closed door, according to which a first transfer of products takes place from the first enclosure into a sterile container by a filling interface thereof and equipped with a seal, the container is transported to the second enclosure and a second transfer of products takes place from the container into the second enclosure by a container emptying interface equipped with a seal, wherein, prior to carrying out each of the first and second transfers:

a tight connection takes place of the corresponding interface and enclosure, a closed volume defined between the corresponding door and seal is sterilized, the corresponding door and seal are opened, to the corresponding enclosure is connected an initially closed flexible hose, which is within the container and connected tightly thereto about the corresponding seal and said flexible hose is opened, and wherein after carrying out the first transfer the flexible hose associated with the filling interface is closed again.

2. Process according to claim 1, wherein each of the enclosures is externally equipped with a lock provided with sterilization means and normally separated from the interior of the enclosure by said door and the corresponding container interface is connected to said lock in order to define said closed volume within the same.

3. Process according to claim 2, wherein the closed volume is sterilized by using intermittent light sterilization means placed around a transparent tube defining said closed volume.

4. Process according to claim 3, wherein use is made of seals, whose face turned towards the outside of the container is reflecting.

5. Process according to claim 2, wherein each lock is connected to the corresponding enclosure by means of a tight transfer device equipped with a double door forming the said door.

6. Process according to claim 1, wherein use is made of tearable seals, which are cut from the interior of the corresponding enclosure, after opening its door.

7. Container for transporting aseptic products between a first enclosure and a second enclosure, said container comprising a filling interface and an emptying interface, both having an opening normally closed by a seal, each of said seals being tearable, in which each of the filling and emptying interfaces also comprises an initially closed flexible hose tightly connected to the corresponding opening within the container, the filling interface flexible hose being reclosable after opening.

8. Container according to claim 7, wherein the filling interface flexible hose is equipped with a means forming a valve.

9. Container according to claim 7 comprising a flexible wall into which are integrated the filling interface and emptying interface.

10. Container according to claim 9, wherein the opening of each interface is defined by an elastic part of the wall.

11. Container according to claim 9, wherein the opening of each interface is defined by a semi-rigid part of the wall.

12. Container for transporting aseptic products between a first enclosure and a second enclosure, said container comprising a filling interface and an emptying interface, both having an opening normally closed by a seal, each of said seals comprises a reflecting face turned towards the outside of the container, in which each of the filling and emptying interfaces also comprises an initially closed flexible hose tightly connected to the corresponding opening within the container, the filling interface flexible hose being reclosable after opening.

13. Container according to claim 12, wherein the filling interface flexible hose is equipped with a means forming a valve.

14. Container according to claim 12 comprising a flexible wall into which are integrated the filling interface and emptying interface.

15. Container according to claim 14, wherein the opening of each interface is defined by an elastic part of the wall.

16. Container according to claim 14, wherein the opening of each interface is defined by a semi-rigid part of the wall.

* * * * *